US008757424B1

(12) United States Patent
Chesser

(10) Patent No.: US 8,757,424 B1
(45) Date of Patent: Jun. 24, 2014

(54) BUCKET

(76) Inventor: Derek S. Chesser, Tampa, FL (US)

( * ) Notice: Subject to any disclaimer, the term of this patent is extended or adjusted under 35 U.S.C. 154(b) by 926 days.

(21) Appl. No.: 12/660,158

(22) Filed: Feb. 22, 2010

Related U.S. Application Data

(60) Provisional application No. 61/208,633, filed on Feb. 26, 2009.

(51) Int. Cl.
*B65D 8/04* (2006.01)

(52) U.S. Cl.
USPC ..... 220/669; 220/695

(58) Field of Classification Search
USPC ..... 220/669–675, 695; 366/605
See application file for complete search history.

(56) References Cited

U.S. PATENT DOCUMENTS

| | | | | | |
|---|---|---|---|---|---|
| 604,514 | A | * | 5/1898 | Belden | 215/382 |
| 1,734,976 | A | * | 11/1929 | McClellan | 220/697 |
| 2,151,895 | A | * | 3/1939 | Carlson | 220/697 |
| 2,180,581 | A | * | 11/1939 | Eisenberg | 220/697 |
| 2,208,431 | A | * | 7/1940 | Rochow | 366/130 |
| 2,519,666 | A | * | 8/1950 | Knox | 220/736 |
| 2,661,858 | A | * | 12/1953 | Howell | 15/257.06 |
| 2,698,450 | A | * | 1/1955 | Mack | 15/257.06 |
| 2,715,478 | A | * | 8/1955 | Andersen | 220/697 |
| 2,963,256 | A | * | 12/1960 | Borah | 248/346.04 |
| 3,273,746 | A | * | 9/1966 | Andrews, Jr. | 220/698 |
| D208,276 | S | | 8/1967 | Moore | |
| 3,375,954 | A | * | 4/1968 | Honkanen et al. | 206/520 |
| 3,395,828 | A | * | 8/1968 | Schnabel | 220/697 |
| 3,648,884 | A | * | 3/1972 | Mansolino | 220/669 |
| D245,672 | S | * | 9/1977 | Grantham | D9/447 |
| 4,203,537 | A | * | 5/1980 | McAlister | 222/570 |
| D295,093 | S | | 4/1988 | Tapdrup | |
| D327,555 | S | | 6/1992 | Juergens | |
| 5,123,576 | A | * | 6/1992 | Lawrence | 222/570 |
| D339,436 | S | | 9/1993 | Craft, Jr. et al. | |
| 5,297,695 | A | * | 3/1994 | Provence | 220/697 |
| D345,833 | S | * | 4/1994 | Truran | D32/54 |
| D353,241 | S | | 12/1994 | Breen | |
| 5,433,337 | A | * | 7/1995 | Willbrandt | 220/669 |
| D379,302 | S | * | 5/1997 | Rodman | D9/440 |
| D391,717 | S | * | 3/1998 | Stein | D32/54 |
| 5,769,266 | A | * | 6/1998 | Willbrandt | 220/669 |
| 6,105,816 | A | * | 8/2000 | Shea | 220/697 |
| D430,459 | S | | 9/2000 | Conti | |
| 6,199,718 | B1 | | 3/2001 | Ellis | |
| D473,790 | S | * | 4/2003 | Nottingham et al. | D9/434 |
| 6,820,848 | B1 | * | 11/2004 | Adam | 248/213.2 |

(Continued)

*Primary Examiner* — David Sorkin
*Assistant Examiner* — Abbas Rashid
(74) *Attorney, Agent, or Firm* — Frijouf, Rust & Pyle, P.A.

(57) ABSTRACT

A container is disclosed for retaining a substance. The container comprises a cylindrical body extending between a bottom aperture and a top aperture. A bottom plate engages the bottom aperture for sealing the bottom aperture of the cylindrical body. A conical flange extends between a first aperture and a second aperture. The first aperture of the conical flange defines a first diameter. The second aperture of the conical flange defines a second diameter. The second diameter of the second aperture has a greater cross-sectional area than the first diameter of the first aperture. The top aperture of the cylindrical body is secured to the first aperture of the conical flange for coupling the cylindrical body to the conical flange. A tubular body extends between a bottom aperture and a top aperture. The bottom aperture of the tubular body is secured to the second aperture of said conical flange for coupling the tubular body with the conical flange.

13 Claims, 6 Drawing Sheets

(56) References Cited

U.S. PATENT DOCUMENTS

| | | | | |
|---|---|---|---|---|
| D524,501 | S | 7/2006 | Prokop et al. | |
| D527,153 | S | 8/2006 | Morad et al. | |
| D544,669 | S | 6/2007 | Casteel et al. | |
| D546,514 | S | 7/2007 | Byrne et al. | |
| D549,416 | S | 8/2007 | Sampaio | |
| D549,913 | S | 8/2007 | Bergman | |
| D636,137 | S | 4/2011 | Chesser | |
| 7,959,030 | B2 * | 6/2011 | Bergman | 220/769 |
| 2004/0173622 | A1 * | 9/2004 | Findleton | 220/695 |
| 2007/0145060 | A1 * | 6/2007 | Connors et al. | 220/780 |
| 2008/0190804 | A1 * | 8/2008 | Blumenschein | 206/509 |

* cited by examiner

BUCKET

CROSS-REFERENCE TO RELATED APPLICATIONS

This application claims benefit of U.S. Patent Provisional application Ser. No. 61/208,633 filed Feb. 26, 2009. All subject matter set forth in provisional application Ser. No. 61/208,633 is hereby incorporated by reference into the present application as if fully set forth herein.

BACKGROUND OF THE INVENTION

1. Field of the Invention

This invention relates to containers and more particularly to the container having both a lower circular cross-section and an upper square cross-section.

2. Background of the Invention

The application of coatings and the like by means of an application device such as a brush or foam applicator tend to become erratic in excess film thickness resulting in runs and insufficient curing as is well known to those skilled in the art. Proper application of the coating requires the application device to have excess coating material removed from the application device prior to application. Removal of excess coatings from the application device is most effective when the application device is drawn across a straight substantially vertical surface. Drawing the application device across a curved vertical surface such as the side of a pail is less effective in producing a uniform coating thickness on the surface of the application device. The obvious resolution to this problem would be to utilize a container having straight sides such as a square pail. Although this remedy would provide the proper contact surface to draw the application device across, it would also introduce a mixing problem. A cylindrical container provides for more uniform mixing than a container having flat sides.

There have been many in the prior art who have attempted to solve these problems with varying degrees of success. None, however completely satisfies the requirements for a complete solution to the aforestated problem. The following U.S. Patents are attempts of the prior art to solve this problem.

U.S. Pat. No. 6,199,718 to Ellis discloses a plastic bucket or pail having a receptacle portion unitarily formed with a grate portion and can be used to apply paint or other suitable materials to a roller. One can squeeze excess paint from the roller by rolling it over the grate. The bucket may be included as part of an integral product in which paint is provided in a sealed bucket.

U.S. Design Pat. D208,276 to Moore discloses an ornamental design for a plastic pail having a first and second straight side and a third curved side.

U.S. Design Pat. D295,093 to Tapdrup discloses an ornamental design for a bucket having four sides.

U.S. Design Pat. D327,555 to Juergens discloses an ornamental design for a refuse container.

U.S. Design Pat. D339,436 to Craft, Jr. et al discloses an ornamental design for a utility tub having a grating proximate the bottom of the tub.

U.S. Design Pat. D353,241 to Breen discloses an ornamental design for a bucket having a straight portion for removing excess material from a brush.

U.S. Design Pat. D430,459 to Conti discloses an ornamental design for a plastic pail.

U.S. Design Pat. D524,501 to Prokop et al. discloses an ornamental design for a liquid container having a suspended surface.

U.S. Design Pat. D527,153 to Morad et al. discloses an ornamental design for a bucket having a brush holder proximate a side of the bucket.

U.S. Design Pat. D544,669 to Casteel et al. discloses a household bucket having a volumetric scale affixed to a side of the household bucket.

U.S. Design Pat. D546,514 to Byrne discloses an ornamental design for a bucket, having a grate affixed to a side of the bucket.

U.S. Design Pat. D549,416 to Sampaio discloses an ornamental design for a bucket.

U.S. Design Pat. D549,913 to Bergman discloses an ornamental design for a container liner having an area for removing excess material from a brush.

Although the aforementioned prior art have contributed to the development of the art of securing an object to a support member, none of these prior art patents have solved the needs of this art.

Therefore, it is an object of the present invention to provide an improved apparatus for uniform mixing a liquid in a container.

Another object of this invention is to provide an improved apparatus for removing excess material from an application device.

Another object of this invention is to provide an improved apparatus that is simple for the operator to use.

Another object of this invention is to provide an improved apparatus that is easy to cost effectively produce.

The foregoing has outlined some of the more pertinent objects of the present invention. These objects should be construed as being merely illustrative of some of the more prominent features and applications of the invention. Many other beneficial results can be obtained by modifying the invention within the scope of the invention. Accordingly other objects in a full understanding of the invention may be had by referring to the summary of the invention, the detailed description describing the preferred embodiment in addition to the scope of the invention defined by the claims taken in conjunction with the accompanying drawings.

SUMMARY OF THE INVENTION

The present invention is defined by the appended claims with specific embodiments being shown in the attached drawings. For the purpose of summarizing the invention, the invention relates to a container for retaining a substance. The substance is agitated within the container by a mixer. The substance is inserted and removed from the container by a tool. The container comprises a cylindrical body extending between a bottom aperture and a top aperture for defining a first interior chamber. The cylindrical body defines an arcurate inner surface for squarely engaging the mixer. A bottom plate engages the bottom aperture for sealing the bottom aperture of the cylindrical body. A conical flange extends between a first aperture and a second aperture for defining a second interior chamber. The first aperture of the conical flange defines a first diameter. The second aperture of the conical flange defines a second diameter. The second diameter of the second aperture has a greater cross-sectional area than the first diameter of the first aperture. The top aperture of the cylindrical body is secured to the first aperture of the conical flange for coupling the cylindrical body to the conical flange. A tubular body extends between a bottom aperture and a top aperture for defining a third interior chamber. The bottom aperture of the tubular body is secured to the second aperture of said conical flange for coupling the tubular body with the conical flange. The top aperture of the tubular body defines a tubular rim for squarely engaging the tool.

In a more specific embodiment of the invention, the cylindrical body defines a circular cross-section for squarely engaging the mixer and the tubular body defines a square cross-section for squarely engaging the tool. The conical flange includes a first arch member, a second arch member, a third arch member and a fourth arch member. The first, second, third and fourth arch members extend between an apex and a first linear edge and a second linear edge. The first linear edge and said second linear edge define a ninety degree there between.

In one embodiment of the invention, a first linear surface is positioned between the first arch member and the second arch member. A second linear surface is positioned between the second arch member and the third arch member. A third linear surface is positioned between the third arch member and the fourth arch member. A fourth linear surface is positioned between the fourth arch member and the first arch member.

The foregoing has outlined rather broadly the more pertinent and important features of the present invention in order that the detailed description that follows may be better understood so that the present contribution to the art can be more fully appreciated. Additional features of the invention will be described hereinafter which form the subject of the claims of the invention. It should be appreciated by those skilled in the art that the conception and the specific embodiments disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a fuller understanding of the nature and objects of the invention, reference should be made to the following detailed description taken in connection with the accompanying drawings in which.

Similar reference characters refer to similar parts throughout the several Figures of the drawings.

DETAILED DISCUSSION

Figure 1:
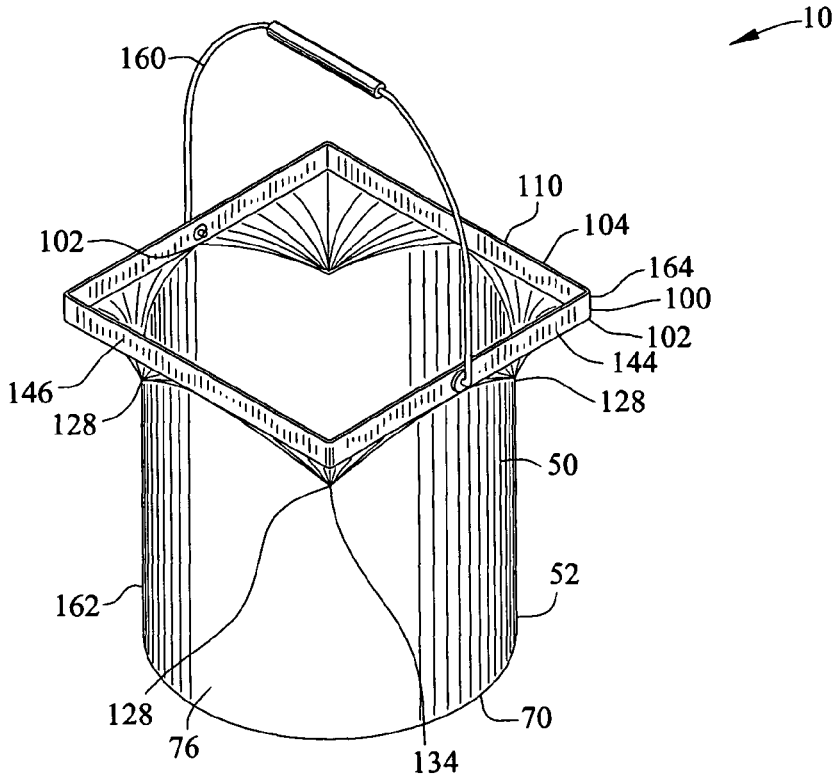
FIG. 1 is a top isometric view of a container for retaining a substance of the present invention.
Figure 2:
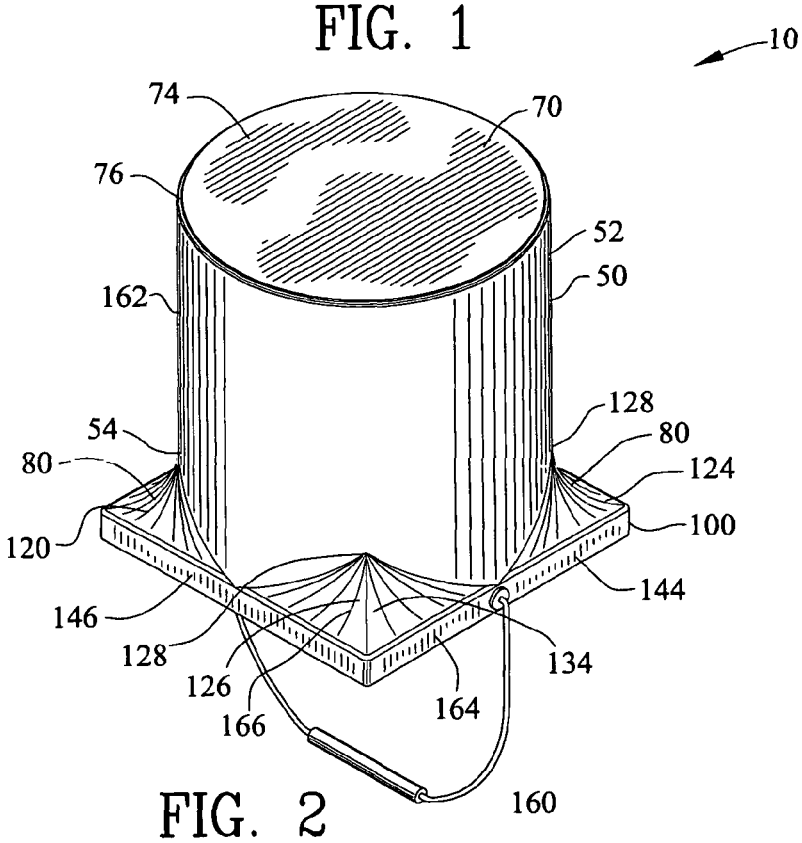
FIG. 2 is a bottom isometric view of FIG. 1.
Figure 3:
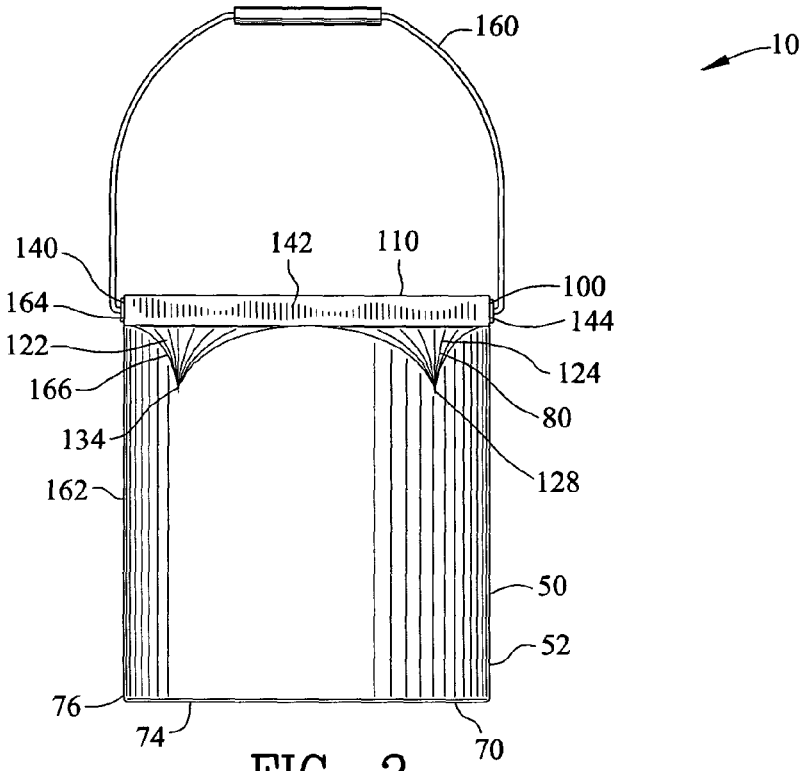
FIG. 3 is a front view of FIG. 1.
Figure 4:
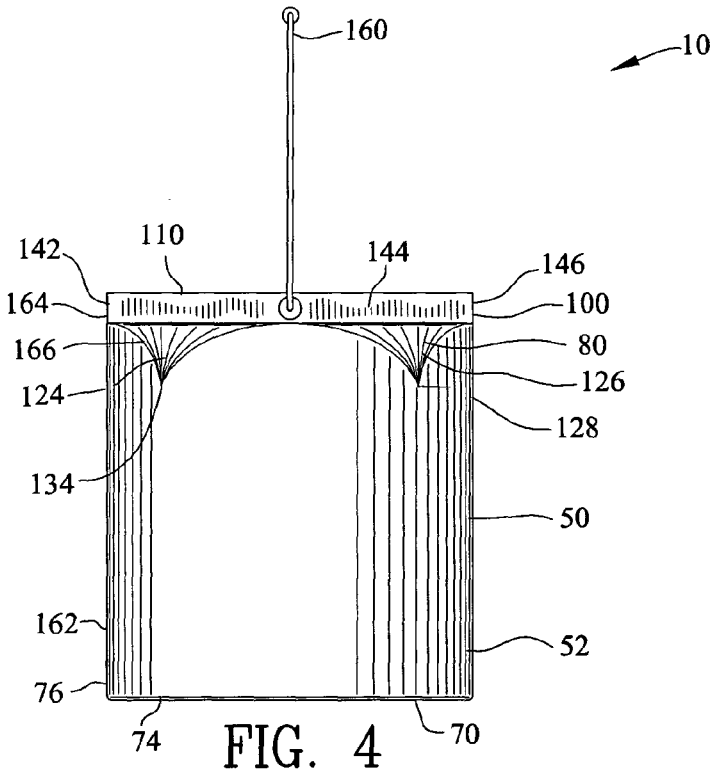
FIG. 4 is a side view of FIG. 1.
Figure 5:
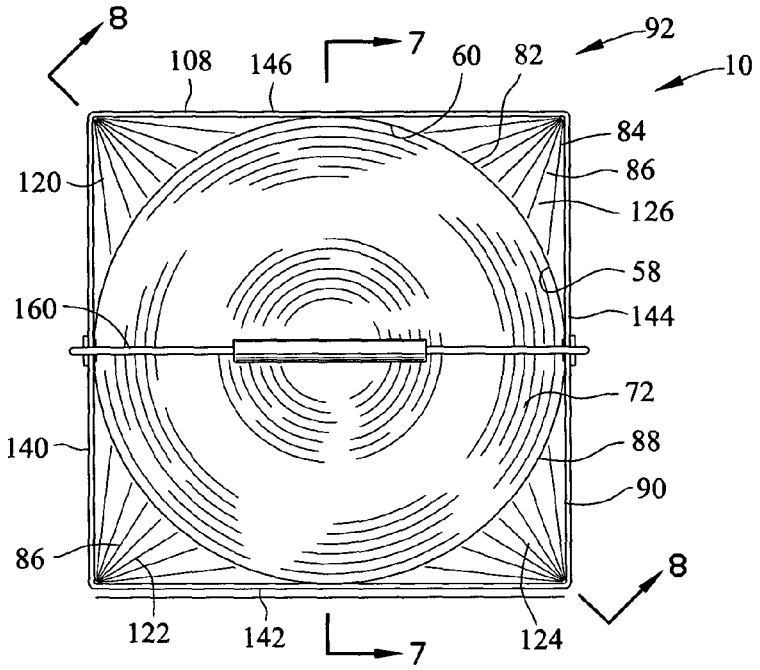
FIG. 5 is a top view of FIG. 1.
Figure 6:
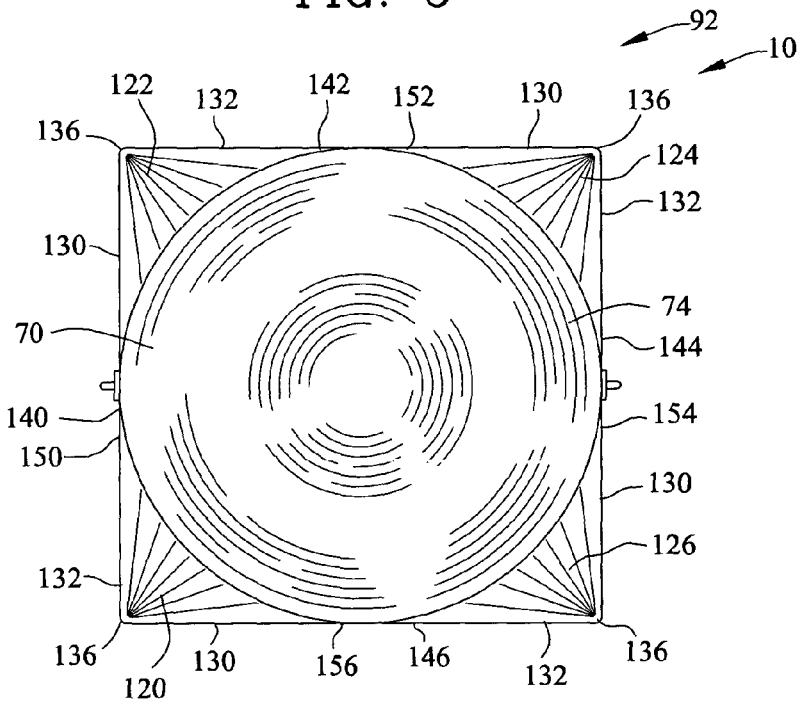
FIG. 6 is a bottom view of FIG. 1.
Figure 7:
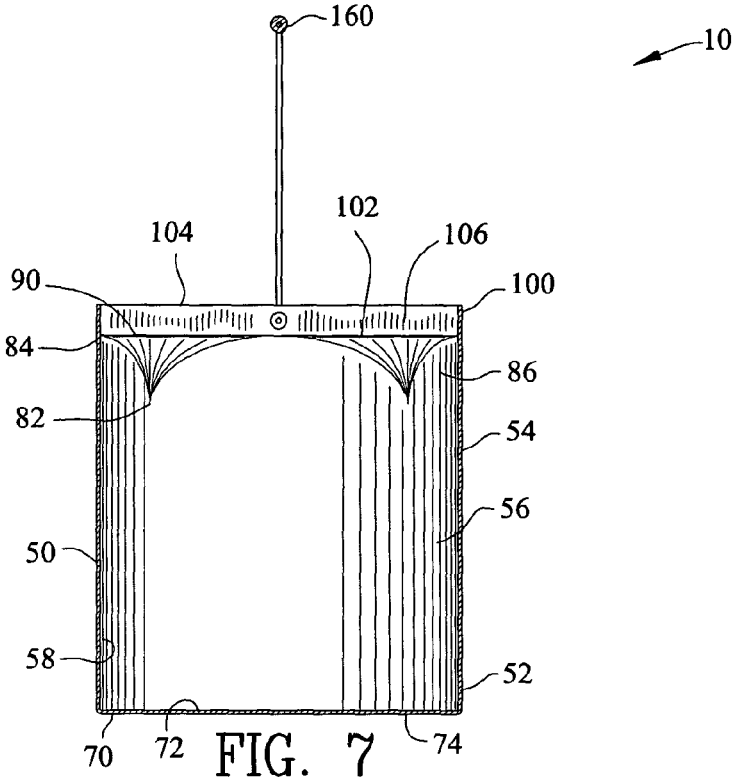
FIG. 7 is a sectional view along line 7-7 in FIG. 5.
Figure 8:
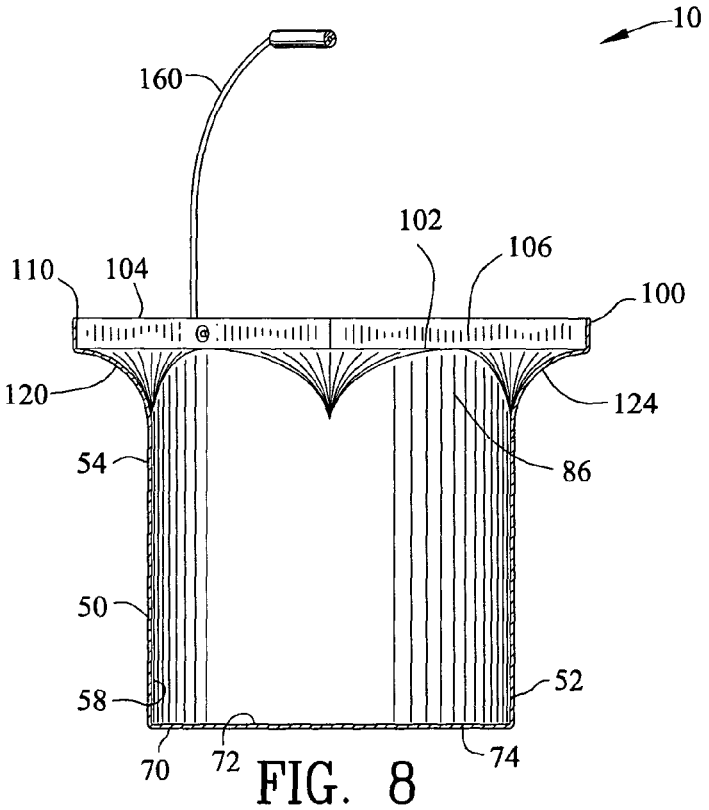
FIG. 8 is a sectional view along line 8-8 in FIG. 5.
Figure 9:
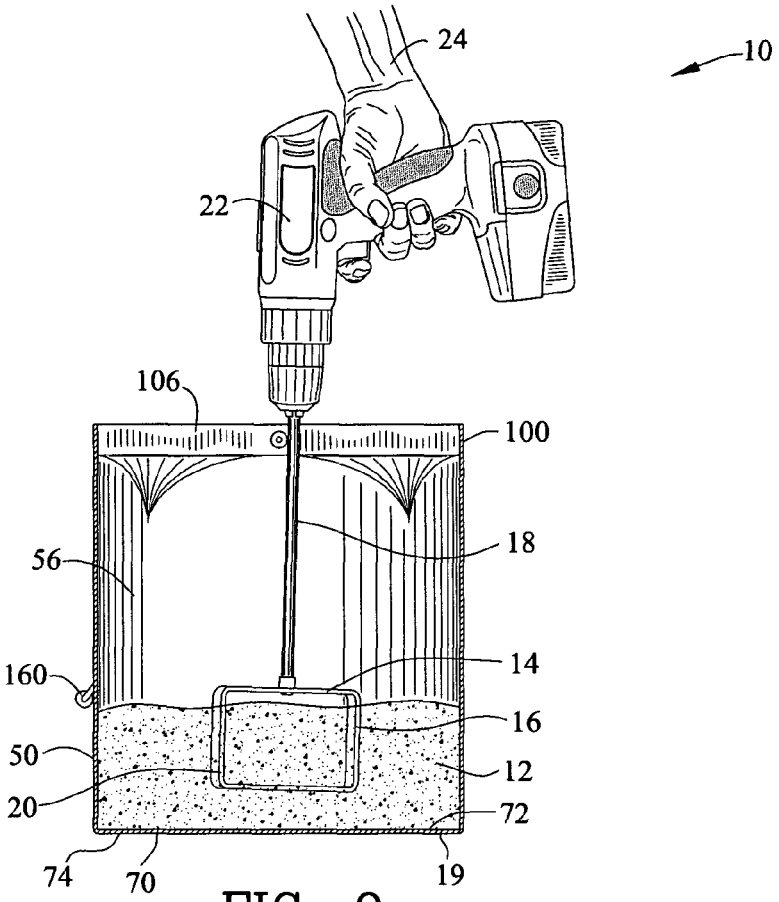
FIG. 9 is a view similar to FIG. 7 illustrating a mixer inserted into the container.
Figure 10:
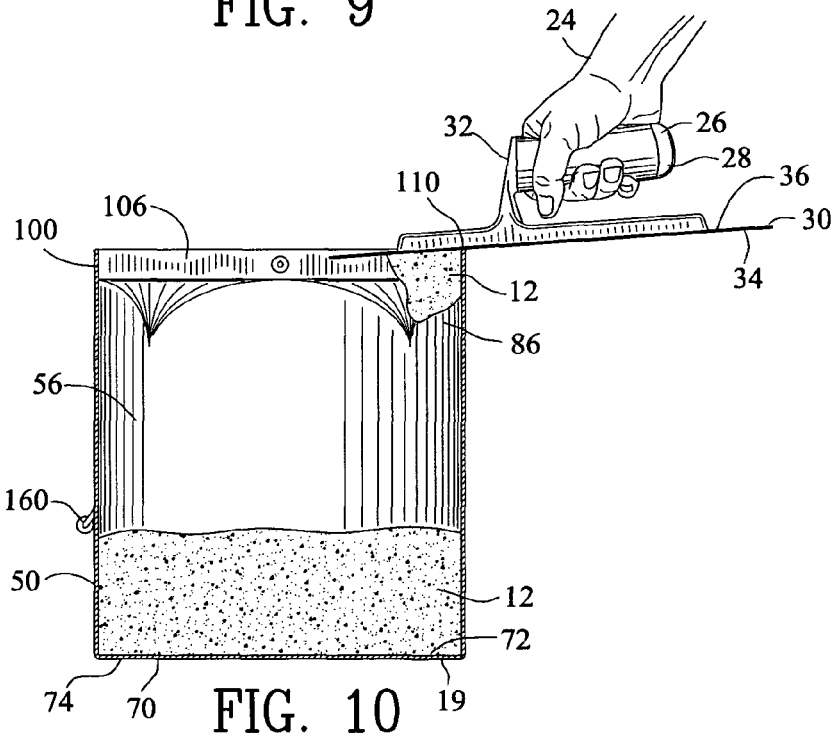
FIG. 10 is a view similar to FIG. 7 illustrating a tool engaging the container for removing the substance from the tool.
Figure 11:
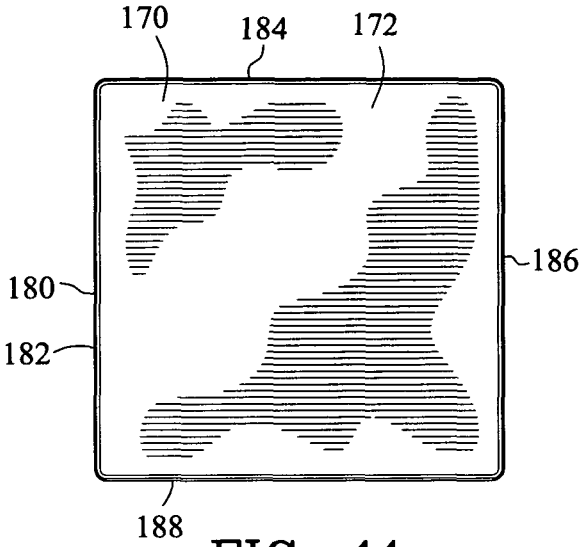
FIG. 11 is a bottom view of a lid for covering the top aperture of the tubular body.
Figure 13:
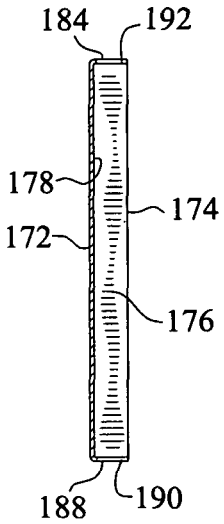
FIG. 13 is a side view of FIG. 11.
Figure 12:
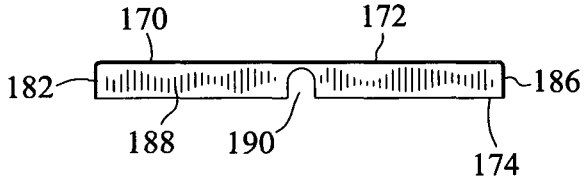
FIG. 12 is a front view of FIG. 11.
Figure 14:
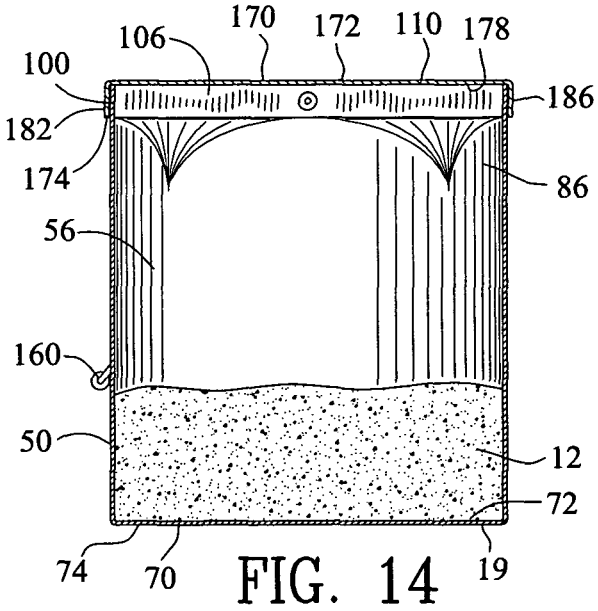
FIG. 14 is a view similar to FIG. 9 illustrating the lid covering the top aperture of the tubular body.

FIGS. 1-14 are various views of a container 10 for retaining a substance 12. The substance 12 may include liquids, solids and/or gas such as concrete, epoxy or other materials. The substance 12 may be agitated within the container 10 by a mixer 14. The mixer 14 may include a paddle mixer 16 or a paint stirrer. The paddle mixer 16 includes a drive shaft 18 coupling a plurality of paddle blades 20 to a rotational power tool 22. The rotational power tool 22 is manipulated by an operator 24. The substance 12 may be inserted and removed from the container by a tool 26. The tool 26 may include a shovel, trowel or other moving device. FIG. 10 illustrates the tool 26 defining a margin trowel 28. The margin trowel 28 includes a rectangular plate 30 coupled to a handle 32. The trowel plate 30 has a bottom surface 34 and a top surface 36 for displacing and/or applying the substance 12.

The container 10 comprises a cylindrical body 50 extending between a bottom aperture 52 and a top aperture 54 for defining a first interior chamber 56. The cylindrical body 50 defines an arcurate inner surface 58 for continuously and squarely engaging the mixer 14. The cylindrical body 50 may further define a circular cross-section 60 for continuously and squarely engaging the mixer 14.

A bottom plate 70 engages the bottom aperture 52 for sealing the bottom aperture 52 of the cylindrical body 50. The bottom plate 70 includes an interior surface 72 and an exterior surface 74. The interior surface 72 supports the substance 12 within the first interior chamber 56. The exterior surface 74 is positioned upon a surface 19 for supporting the container 10. Preferably, the bottom plate 70 and the cylindrical body 50 is an integral one piece unit 76.

A conical flange 80 extends between a first aperture 82 and a second aperture 84 for defining a second interior chamber 86. The first aperture 82 of the conical flange 80 defines a first diameter 88. The second aperture 84 of the conical flange 80 defines a second diameter 90. The second diameter 90 of the second aperture 84 has a greater cross-sectional area 92 than the first diameter 88 of the first aperture 82. The top aperture 54 of the cylindrical body 50 is secured to the first aperture 82 of the conical flange 80 for coupling the cylindrical body 50 to the conical flange 80. Preferably, the conical flange 80 and the cylindrical body 50 is an integral one piece unit 76.

A tubular body 100 extends between a bottom aperture 102 and a top aperture 104 for defining a third interior chamber 106. The bottom aperture 102 of the tubular body 100 is secured to the second aperture 84 of the conical flange 80 for coupling the tubular body 100 with the conical flange 80. Preferably, the tubular body 100 defines a square cross-section 108. Furthermore, the top aperture 104 of the tubular body 100 defines a tubular rim 110 for continuous and squarely engaging the rectangular plate 30 of the tool 26. Preferably, cylindrical body 50, the conical flange 80 and the tubular body 100 include an integral one piece unit 76. The integral one piece unit 76 may be constructed from a polymeric, metallic or other rigid materials.

The conical flange 80 may further include a first arch member 120, a second arch member 122, a third arch member 124 and a fourth arch member 126. Each of the first, second, third and fourth arch members 120, 122, 124 and 126 extend between a lower apex 128 and a first upper linear edge 130 and a second upper linear edge 132. A generally V-shaped body 134 extends between the lower apex 128 and the first and second upper linear edges 130 and 132. The angle 136 between the first upper linear edge 130 and the second upper linear edge 132 is ninety degrees.

A first linear surface 140 may be positioned between the first arch member 120 and the second arch member 122. The first linear surface 140 may extend between the cylindrical body 50 and the tubular body for defining a first linear plane 150. A second linear surface 142 may be positioned between the second arch member 122 and the third arch member 124. The second linear surface 142 may extend between the cylindrical body 50 and the tubular body for defining a second linear plane 152. A third linear surface 144 may be positioned between the third arch member 124 and the fourth arch member 126. The third linear surface 144 may extend between the cylindrical body 50 and the tubular body for defining a third linear plane 154. A fourth linear surface 146 may be positioned between the fourth arch member 126 and the first arch member 120. The fourth linear surface 146 may extend between the cylindrical body 50 and the tubular body for defining a fourth linear plane 156.

The container 10 may include a handle coupled to the tubular body 100 for transporting and/or pivoting the container 10. The cylindrical body 50 includes a cylindrical height 162. The tubular body 100 includes a tubular height 164. Preferably, the cylindrical height 162 is greater height than the tubular height 164 for permitting large volumes of the substance 12 to be mixed within the first interior chamber 56. The conical flange 80 includes a conical flange height 166. The conical flange height 166 is preferably greater than the tubular height 164.

Since the cylindrical body 50 includes a circular cross-section 60, the rotating paddle mixer 16 is able to be positioned immediately adjacent both the arcurate inner surface 58 and the interior surface 72 of the bottom plate 70 in order to thoroughly mix the substance 12. The square cross-section 108 of the tubular body 100 permits either the bottom surface 34 or the top surface 36 of the margin trowel 28 to be positioned immediately adjacent to the tubular rim 110 of the tubular body 100 for removing the substance 12 from the tool 26.

FIGS. 11-14 illustrate a lid 170 for covering the top aperture 104 of the tubular body 100. The lid 170 includes a top surface 172 and a bottom surface 178. A lid frame 174 defines a square cross section 180 for engaging over the tubular rim 110. The lid frame 174 includes a first linear surface 192, a second linear surface 184, a third linear surface 186 and a fourth linear surface 188. The lid 170 and the lid frame 174 define a lid aperture 176 for receiving the tubular body 100. The second linear surface 184 and the fourth linear surface 188 may include a first handle aperture 190 and a second handle aperture 192 respectively for permitting the lid 170 fully engage the tubular body 100 and permit the handle 160 to engage the tubular body 100.

The present disclosure includes that contained in the appended claims as well as that of the foregoing description. Although this invention has been described in its preferred form with a certain degree of particularity, it is understood that the present disclosure of the preferred form has been made only by way of example and that numerous changes in the details of construction and the combination and arrangement of parts may be resorted to without departing from the spirit and scope of the invention.

What is claimed is:

1. A container for retaining a substance, the substance being agitated within the container by a mixer, the substance being inserted and removed from the container by a tool, the container, comprising:

a cylindrical body extending between a bottom aperture and a top aperture for defining a first in interior chamber;

said cylindrical body defining an arcuate inner surface for squarely engaging the mixer;

a bottom plate engaging said bottom aperture for sealing said bottom aperture of said cylindrical body;

a conical flange extending between a first aperture and a second aperture for defining a second interior chamber;

said first aperture of said conical flange defining a first diameter;

said second aperture of said conical flange defining a second diameter;

said second diameter of said second aperture having a greater cross-sectional area than said first diameter of said first aperture;

said top aperture of said cylindrical body secured to said first aperture of said conical flange for coupling said cylindrical body to said conical flange;

a tubular body extending between a bottom aperture and a top aperture for defining a third interior chamber;

said bottom aperture of said tubular body secured to said second aperture of said conical flange for coupling said tubular body with said conical flange;

said top aperture of said tubular body defining a tubular rim for squarely engaging the tool; and said tubular body defines a square cross-section for squarely engaging the tool.

2. A container for retaining a substance as set forth in claim 1, wherein said cylindrical body defines a circular cross-section for squarely engaging the mixer.

3. A container for retaining a substance as set forth in claim 1, wherein said cylindrical body, said conical flange and said tubular body include an integral one piece unit.

4. A container for retaining a substance as set forth in claim 1, wherein said conical flange includes a first arch member, a second arch member, a third arch member and a fourth arch member;

said first, second, third and fourth arch members extending between an apex and a first linear edge and a second linear edge; and said first linear edge and said second linear edge defining a ninety degree angle there between.

5. A container for retaining a substance as set forth in claim 1, wherein said conical flange includes a first arch member, a second arch member, a third arch member and a fourth arch member;

a first linear surface positioned between said first arch member and said second arch member;

a second linear surface positioned between said second arch member and said third arch member;

a third linear surface positioned between said third arch member and said fourth arch member; and a fourth linear surface positioned between said fourth arch member and said first arch member.

6. A container for retaining a substance as set forth in claim 1, further including a handle coupled to said tubular body for transporting and/or pivoting the container.

7. A container for retaining a substance as set forth in claim 1, wherein said cylindrical body includes a cylindrical height;

said tubular body including a tubular height; and said cylindrical height having a greater height than said tubular height.

8. A container for retaining a substance as set forth in claim 1, wherein said cylindrical body includes a cylindrical height;

said conical flange including a conical flange height;

said tubular body including a tubular height;

said cylindrical height having a greater height than said tubular height; and said conical flange height having a greater height than said tubular height.

9. A container for retaining a substance, the substance being agitated within the container by a mixer, the substance being inserted and removed from the container by a tool, the container, comprising:

a cylindrical body extending between a bottom aperture and a top aperture for defining a first interior chamber;

said cylindrical body defining a circular cross-section for squarely engaging the mixer;

said interior chamber of said cylindrical body maintaining the substance;

a bottom plate engaging said bottom aperture for sealing said bottom aperture of said cylindrical body;

a conical flange extending between a first aperture and a second aperture for defining a second interior chamber;

said first aperture of said conical flange defining a first diameter;

said second aperture of said conical flange defining a second diameter;

said second diameter of said second aperture having a greater cross-sectional area than said first diameter of said first aperture;

said top aperture of said cylindrical body secured to said first aperture of said conical flange for coupling said cylindrical body to said conical flange;

a tubular body extending between a bottom aperture and a top aperture for defining a third interior chamber;

said bottom aperture of said tubular body secured to said second aperture of said conical flange for coupling said tubular body with said conical flange;

said tubular body defining a square cross-section for squarely engaging the tool; and said second interior chamber conveying the substance from the third interior chamber of said tubular body to said first interior chamber of said cylindrical body.

10. A container for retaining a substance, comprising:

a cylindrical body extending between a bottom aperture and a top aperture for defining a first interior chamber;

said cylindrical body defining a circular cross-section;

said interior chamber of said cylindrical body maintaining the substance;

a bottom plate engaging said bottom aperture for sealing said bottom aperture of said cylindrical body;

a conical flange extending between a first aperture and a second aperture for defining a second interior chamber;

said first aperture of said conical flange defining a first diameter;

said second aperture of said conical flange defining a second diameter;

said second diameter of said second aperture having a greater cross-sectional area than said first diameter of said first aperture;

said top aperture of said cylindrical body secured to said first aperture of said conical flange for coupling said cylindrical body to said conical flange;

a tubular body extending between a bottom aperture and a top aperture for defining a third interior chamber;

said bottom aperture of said tubular body secured to said second aperture of said conical flange for coupling said tubular body with said conical flange; and said tubular body defining a square cross-section.

11. A container for retaining a substance, the substance being agitated within the container by a mixer, the substance being inserted and removed from the container by a tool, the container, comprising:

a cylindrical body extending between a bottom aperture and a top aperture for defining a first interior chamber;

said cylindrical body defining an arcuate inner surface for squarely engaging the mixer;

a bottom plate engaging said bottom aperture for sealing said bottom aperture of said cylindrical body;

a conical flange extending between a first aperture and a second aperture for defining a second interior chamber;

said first aperture of said conical flange defining a first diameter;

said second aperture of said conical flange defining a second diameter;

said second diameter of said second aperture having a greater cross-sectional area than said first diameter of said first aperture;

said top aperture of said cylindrical body secured to said first aperture of said conical flange for coupling said cylindrical body to said conical flange;

a tubular body extending between a bottom aperture and a top aperture for defining a third interior chamber;

said bottom aperture of said tubular body secured to said second aperture of said conical flange for coupling said tubular body with said conical flange;

said top aperture of said tubular body defining a tubular rim for squarely engaging the tool;

said conical flange includes a first arch member, a second arch member, a third arch member and a fourth arch member;

said first, second, third and fourth arch members extending between an apex and a first linear edge and a second linear edge; and said first linear edge and said second linear edge defining a ninety degree angle there between.

12. A container for retaining a substance, the substance being agitated within the container by a mixer, the substance being inserted and removed from the container by a tool, the container, comprising:

a cylindrical body extending between a bottom aperture and a top aperture for defining a first interior chamber;

said cylindrical body defining an arcuate inner surface for squarely engaging the mixer;

a bottom plate engaging said bottom aperture for sealing said bottom aperture of said cylindrical body;

a conical flange extending between a first aperture and a second aperture for defining a second interior chamber;

said first aperture of said conical flange defining a first diameter;

said second aperture of said conical flange defining a second diameter;

said second diameter of said second aperture having a greater cross-sectional area than said first diameter of said first aperture;

said top aperture of said cylindrical body secured to said first aperture of said conical flange for coupling said cylindrical body to said conical flange;

a tubular body extending between a bottom aperture and a top aperture for defining a third interior chamber;

said bottom aperture of said tubular body secured to said second aperture of said conical flange for coupling said tubular body with said conical flange;

said top aperture of said tubular body defining a tubular rim for squarely engaging the tool;

wherein said conical flange includes a first arch member, a second arch member, a third arch member and a fourth arch member;

a first linear surface positioned between said first arch member and said second arch member;

a second linear surface positioned between said second arch member and said third arch member;

a third linear surface positioned between said third arch member and said fourth arch member; and a fourth linear surface positioned between said fourth arch member and said first arch member.

13. A container for retaining a substance, the substance being removed from the container, the container, comprising:

a cylindrical body extending between a bottom aperture and a top aperture for defining, a first interior chamber;

said cylindrical body defining an arcuate inner surface;

a bottom plate engaging said bottom aperture for sealing said bottom aperture of said cylindrical body;

a conical flange extending between a first aperture and a second aperture for defining a second interior chamber;

said first aperture of said conical flange defining a first diameter;

said second aperture of said conical flange defining a second diameter;

said second diameter of said second aperture haying a greater cross-sectional area than said first diameter of said first aperture;

said top aperture of said cylindrical body secured to said first aperture of said conical flange for coupling said cylindrical body to said conical flange;

a tubular body extending between a bottom aperture and a top aperture for defining a third interior chamber;

said bottom aperture of said tubular body secured to said second aperture of said conical flange for coupling said tubular body with said conical flange;

said top aperture of said tubular body defining a tubular rim for squarely engaging the tool; and said tubular body defines a square cross-section for squarely engaging the tool.

* * * * *